US010113278B1

(12) United States Patent
Carney

(10) Patent No.: US 10,113,278 B1
(45) Date of Patent: Oct. 30, 2018

(54) MODULE FOR DEICING A CABLE SHEATH AND METHOD FOR USING THE SAME

(71) Applicant: American Bridge Maintenance Services Company, Coraopolis, PA (US)

(72) Inventor: Carson T. Carney, Cranberry Township, PA (US)

(73) Assignee: American Bridge Maintenance Services Company, Coraopolis, PA (US)

( * ) Notice: Subject to any disclaimer, the term of this patent is extended or adjusted under 35 U.S.C. 154(b) by 0 days.

(21) Appl. No.: 15/977,658

(22) Filed: May 11, 2018

Related U.S. Application Data

(60) Provisional application No. 62/653,826, filed on Apr. 6, 2018.

(51) Int. Cl.
*E01D 19/16* (2006.01)
*E01D 11/04* (2006.01)

(52) U.S. Cl.
CPC ..... *E01D 19/16* (2013.01); *E01D 11/04* (2013.01)

(58) Field of Classification Search
CPC ..... E01D 11/04; E01D 19/16
USPC ..... 14/18, 22
See application file for complete search history.

(56) References Cited

U.S. PATENT DOCUMENTS 2,121,478 A 6/1938 Dorman
2,870,311 A * 1/1959 Greenfield ..... H01B 5/08 174/102 R
3,672,610 A * 6/1972 Levin ..... B06B 1/023 244/134 R
3,809,341 A * 5/1974 Levin ..... B64D 15/163 244/134 R
5,411,121 A 5/1995 LaForte et al.
5,871,302 A * 2/1999 Carlson ..... E01C 19/40 404/114
6,138,930 A 10/2000 Gagnon et al.
6,518,497 B1 * 2/2003 Allaire ..... H02G 7/16 174/40 R
6,660,934 B1 12/2003 Nourai et al.
7,310,948 B2 12/2007 Shirmohamadi
8,806,692 B2 8/2014 Zhang et al.
9,062,421 B2 * 6/2015 Brand ..... E01D 19/16
9,590,407 B2 * 3/2017 Kim ..... H02G 7/16
9,979,174 B2 * 5/2018 Jokinen ..... B08B 7/02
2002/0170909 A1 11/2002 Petrenko
2004/0065458 A1 4/2004 Hansen
(Continued)

FOREIGN PATENT DOCUMENTS

CA 2802204 A1 7/2014
CN 101692571 A 4/2010
(Continued)

OTHER PUBLICATIONS

4Front Robotics Publication, "Ground-Up Design," 2012.
(Continued)

*Primary Examiner* — Gary S Hartmann
(74) *Attorney, Agent, or Firm* — The Webb Law Firm

(57) ABSTRACT

A module for deicing a cable sheath has a mass, a vibrator, and a base. The module may be placed inside a sheath, such as a sheath surrounding stay strands in a cable stayed bridge, for vibrating the sheath to prevent and/or remove snow and/or ice accumulation from the sheath.

18 Claims, 7 Drawing Sheets

(56) References Cited

U.S. PATENT DOCUMENTS

| | | | | |
|---|---|---|---|---|
| 2007/0278349 | A1* | 12/2007 | Bembridge | H02G 7/16 244/134 R |
| 2015/0026901 | A1 | 1/2015 | Brand | |

FOREIGN PATENT DOCUMENTS

| | | | |
|---|---|---|---|
| CN | 104868427 | A | 8/2015 |
| WO | 9526063 | A1 | 9/1995 |

OTHER PUBLICATIONS

DYWIDAG-Systems International, "DYWIDAG Multistrand Stay Cable Systems," DSI, pp. 1-52.
Brdige Design & Engineering Publication, "Ice Interceptors," Nov. 7, 2017, pp. 1-12.
Jung et al., "Field Application of a Robotic System on Cable Stays of Incheon Bridge for Snow Removal," pp. 1415-1416.
Kleissl, "Bridge ice accretion and de- and anti-icing systems: A review," Technical University of Denmark, 2010, pp. 1-8.
Topomachines, 2017, www.topomachines.com, pp. 1-3.

* cited by examiner

MODULE FOR DEICING A CABLE SHEATH AND METHOD FOR USING THE SAME

This application claims the benefit of U.S. Provisional Application No. 62/653,826 filed Apr. 6, 2018. The disclosure of this application is hereby incorporated in its entirety by reference.

BACKGROUND OF THE INVENTION

Field of the Invention

The present invention relates to the deicing of cable sheaths and, more particularly, to a module fitted within a sheath for removal of snow and/or ice. The sheath may surround cables on a cable stayed bridge.

Description of Related Art

Cable stayed bridges are becoming more prevalent as an economic solution to long span bridges. However, the cables for such bridges are prone to accumulate ice during inclement weather and these ice accumulations may break off and fall from the cables, creating what are known as "ice bombs". These "ice bombs" may fall to the bridge deck and cause damage or injuries. A similar phenomenon may occur with excessive snow accumulation on the cables. Designers for cable stayed bridges are now beginning to include physical cable deicing solutions as part of the initial bridge design and construction. Such problems may also exist on other bridges with cables such as, but not limited to, suspension bridges where suspender cables support a bridge deck and the suspender cables are themselves supported by a structural arch or main cables attached to towers or archways.

There are several systems that are proposed for the market to prevent the accumulation of snow and/or ice on such structures. Examples of proposed cable deicing solutions are:

Brute force to manually remove the ice through impact;
Heated sheaths;
Scraping collars;
Nets below the cables;
Scraping robots;
Electro-pulse technology to vibrate the sheath; and
Sheath rotating systems to deform the sheath.

A full system of gravity-activated scraping collars has already been used on a cable stayed bridge. While the collars were effective in preventing the ice accumulations, they also caused damage to the sheaths. In addition to this damage, such a scraping system requires an extraordinary amount of labor for maintenance.

All of the solutions that are known to exist focus on the exterior of the stay cables and require an inordinate amount of maintenance.

A device and method are needed for removing snow and/or ice from the cables of bridges in a different fashion.

SUMMARY OF THE INVENTION

One embodiment of the invention is directed to a module for placement inside a sheath for vibrating the sheath. The sheath has a body with a mass, a vibrator attached to the mass, and a base supporting the mass and vibrator and adapted to contact an inner wall of the sheath.

Another embodiment of the invention is directed to a vibrating system having a sheath, wherein the sheath surrounds a plurality of strands and there is an interstitial space between the strands and the inner wall of the sheath. The system also has a module with a body having a mass, a vibrator attached to the mass, and a base supporting the mass and vibrator. The module fits within the interstitial space and the base contacts an inner wall of the sheath.

Yet another embodiment of the invention is directed to a method for vibrating a sheath containing a plurality of strands and having an interstitial space between the strands and the inner wall of the sheath. The method uses a module with a vibrating mass. The method is made up of the steps of positioning the module within the interstitial space of the sheath and against the inner wall of the sheath and activating the vibrator to impart vibration to the sheath.

DESCRIPTION OF THE INVENTION

Figure 1:
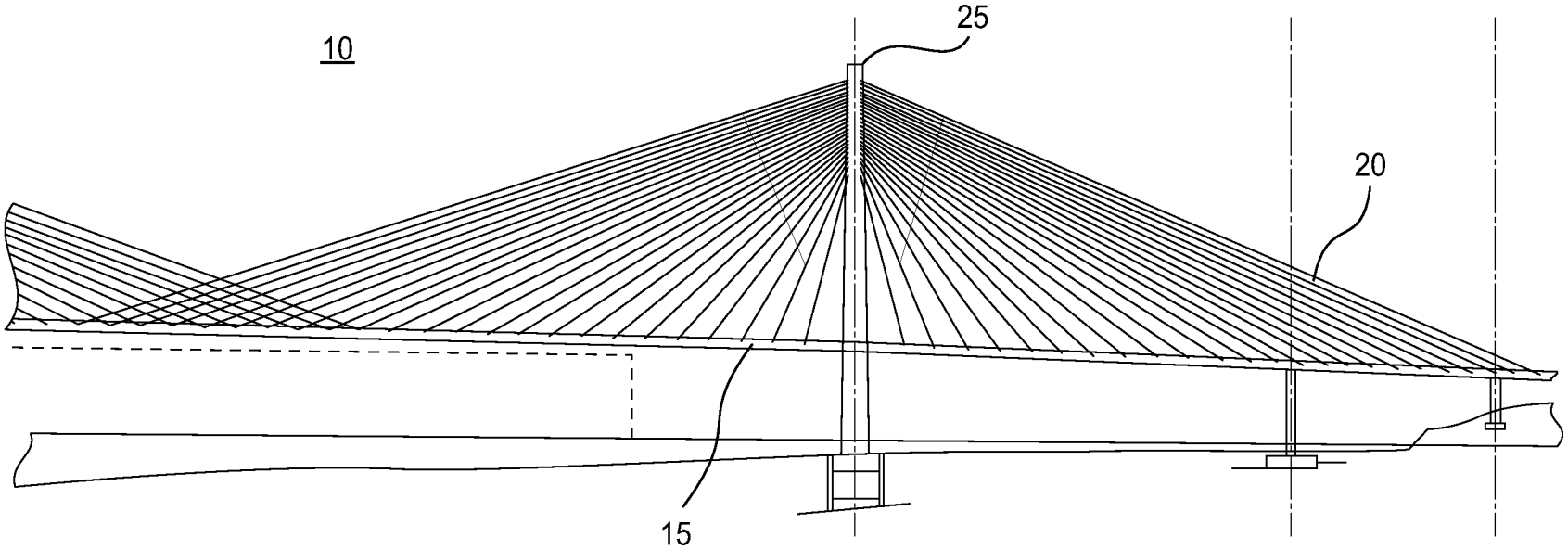
FIG. 1 is an elevation view of a cable stayed bridge.

FIG. 1 illustrates a cable stayed bridge 10 having a bridge deck 15 supported by a plurality of cables 20 extending along and connected to the bridge deck 15 at one end and secured to a structural support 25 at the other end. As mentioned, ice or snow accumulating on the exterior of these cables 20 may fall upon the bridge deck 15. While the term "deicing" is used herein, it should be appreciated that, in addition to removing ice from the cables, the device described herein may also be applied to remove snow from the cables.

Figure 2:
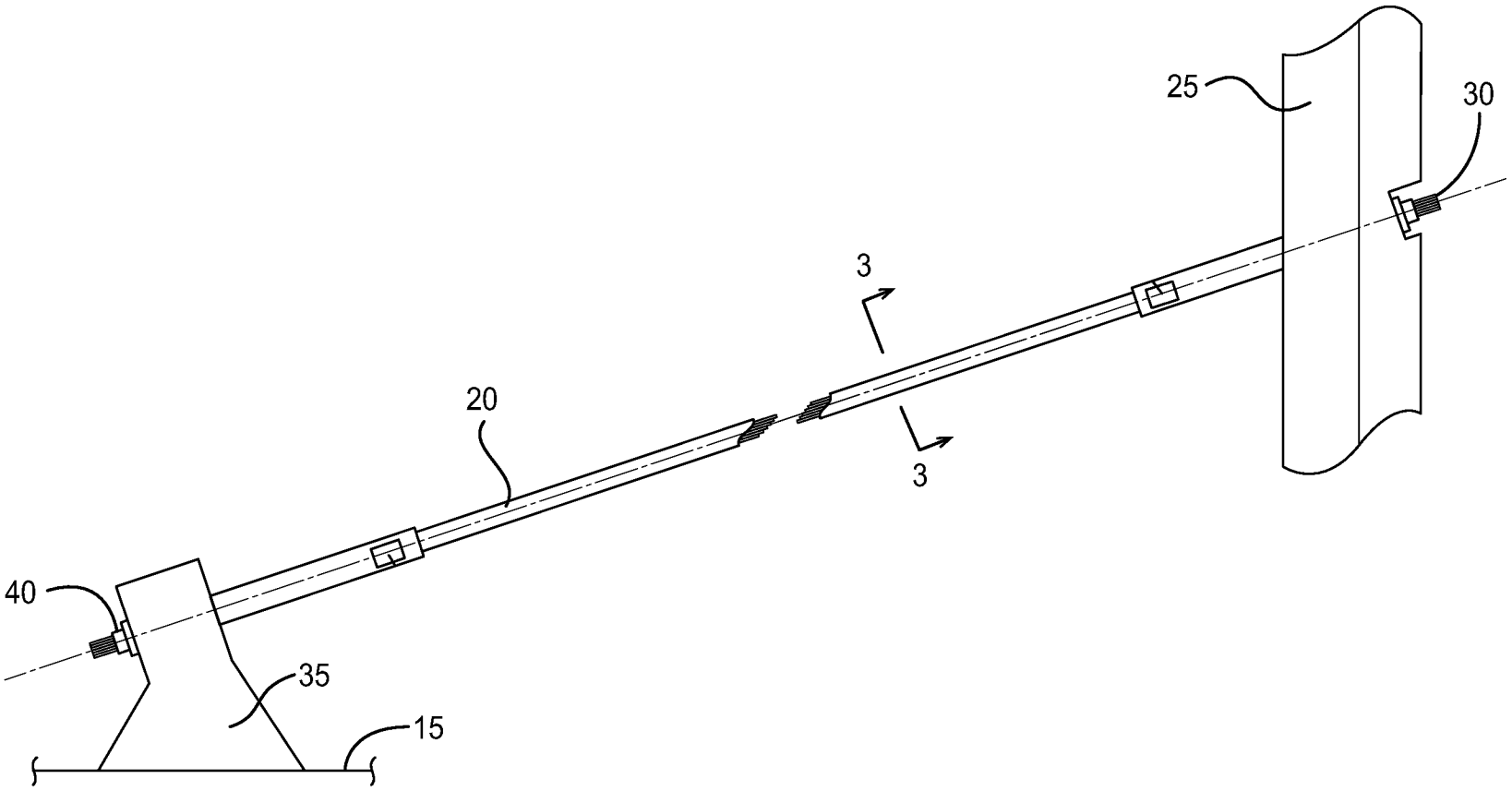
FIG. 2 is an elevation view of a cable of a cable stayed bridge.

FIG. 2 provides additional details of a cable 20, which in particular, is attached to the structural support 25 using a tension system anchorage 30 known to those skilled in the art. The cable 20 is attached to an anchorage support 35 at the bridge deck 15 using a similar tension system anchorage 40.

Figure 3:
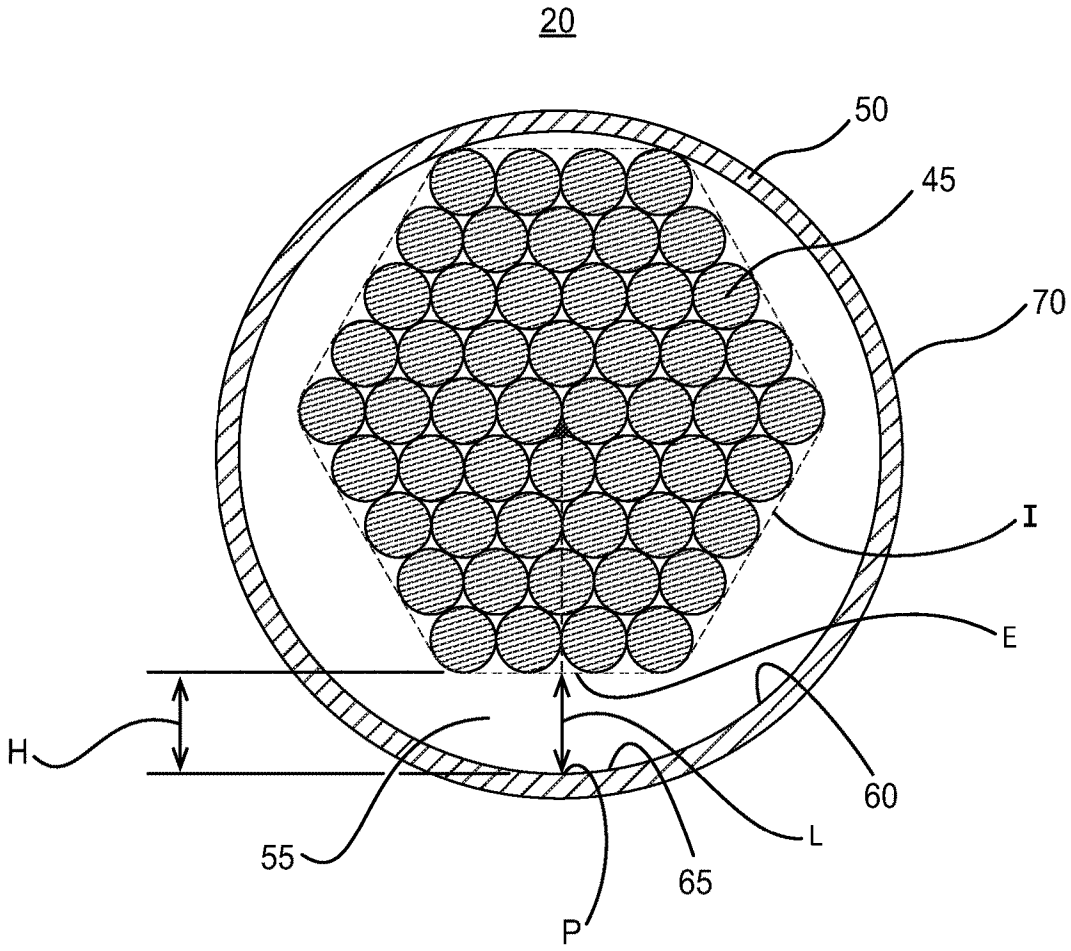
FIG. 3 is a cross-section along arrows "3-3" in FIG. 2.

Directing attention to FIG. 3, the term cable 20 as used herein is directed to a plurality of tension elements or strands 45 surrounded by a corrosion protection sheath 50. The sheath 50 is typically made of an HDPE or steel pipe.

A typical HDPE sheath 50 is round and may have a diameter ranging from about 5 to 12.5 inches. During assembly of the bridge 10, the strands 45 are fed into the sheath 50 using a shuttle to carry one or more strands through the length of the sheath 50. The shuttle moves in a lower free space or interstitial space 55 between the strands 45 and the inner wall 60 of the interior of the sheath 50.

The height H of the interstitial space 55 varies depending upon the configuration and the number of strands 45 within the sheath 50. As illustrated in FIG. 3, the height H at a point of interest P on the inner wall 60 of the sheath 50 is the length of a radial line L extending from P to the edge E of an imaginary envelope I around the strands 45. While in FIG. 3 the interstitial space 55 is illustrated at the bottom of the sheath 50, this interstitial space extends about the sheath 50 and the height H defining the interstitial space 55 may be taken from any point along the inner wall 60 of the sheath 50. In the event the sheath is not round, then the height is the shortest length measured from the point of interest on the inner wall of the sheath to an imaginary envelope around the sheath.

The inventor has realized that this interstitial space, which was previously used only during the bridge construction, may also be used for maintenance after construction. In particular, the inventor has realized that introducing a shuttle module within this interstitial space 55 capable of imparting vibration to the sheath 50 may be utilized to prevent significant ice accumulations by breaking up ice formation on the exterior surface of the sheath 50 early in the ice formation while the mass of the ice that may fall is sufficiently small to avoid damage or injury.

Figure 4:
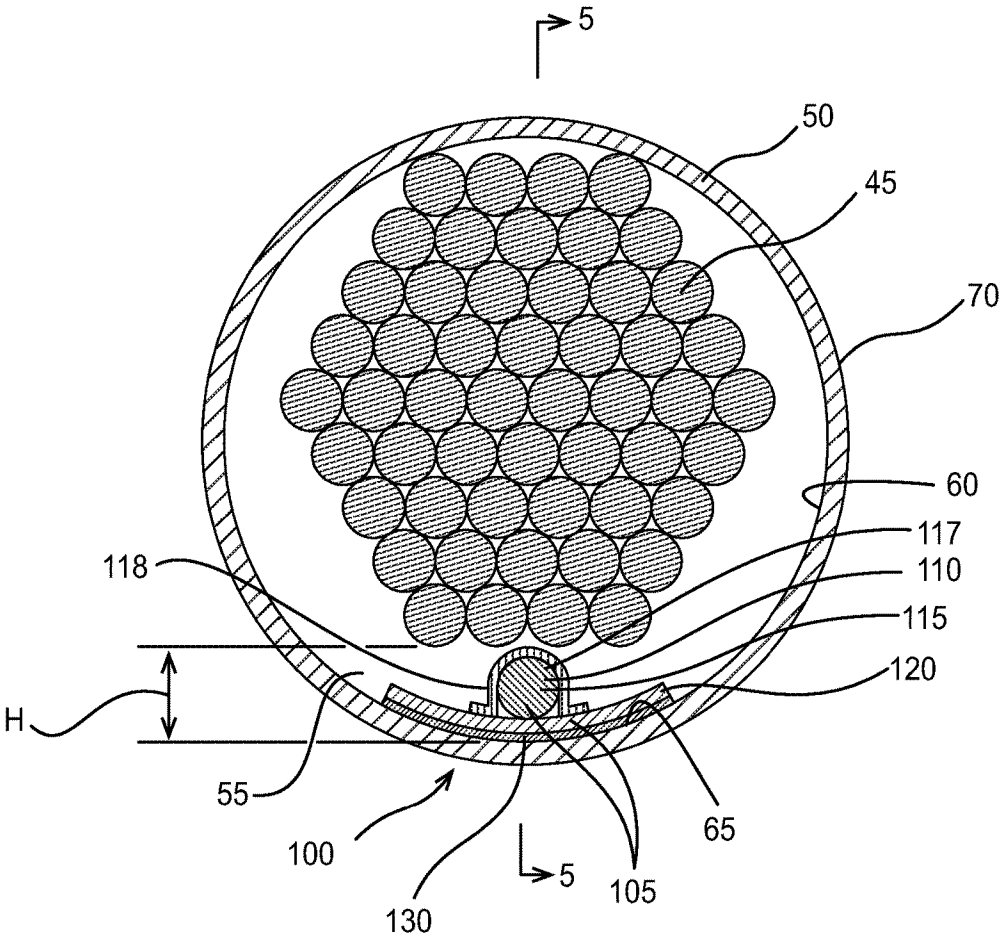
FIG. 4 is a cross-section along arrows "3-3" in FIG. 2, but includes a deicing module in accordance with the subject invention.
Figure 5:
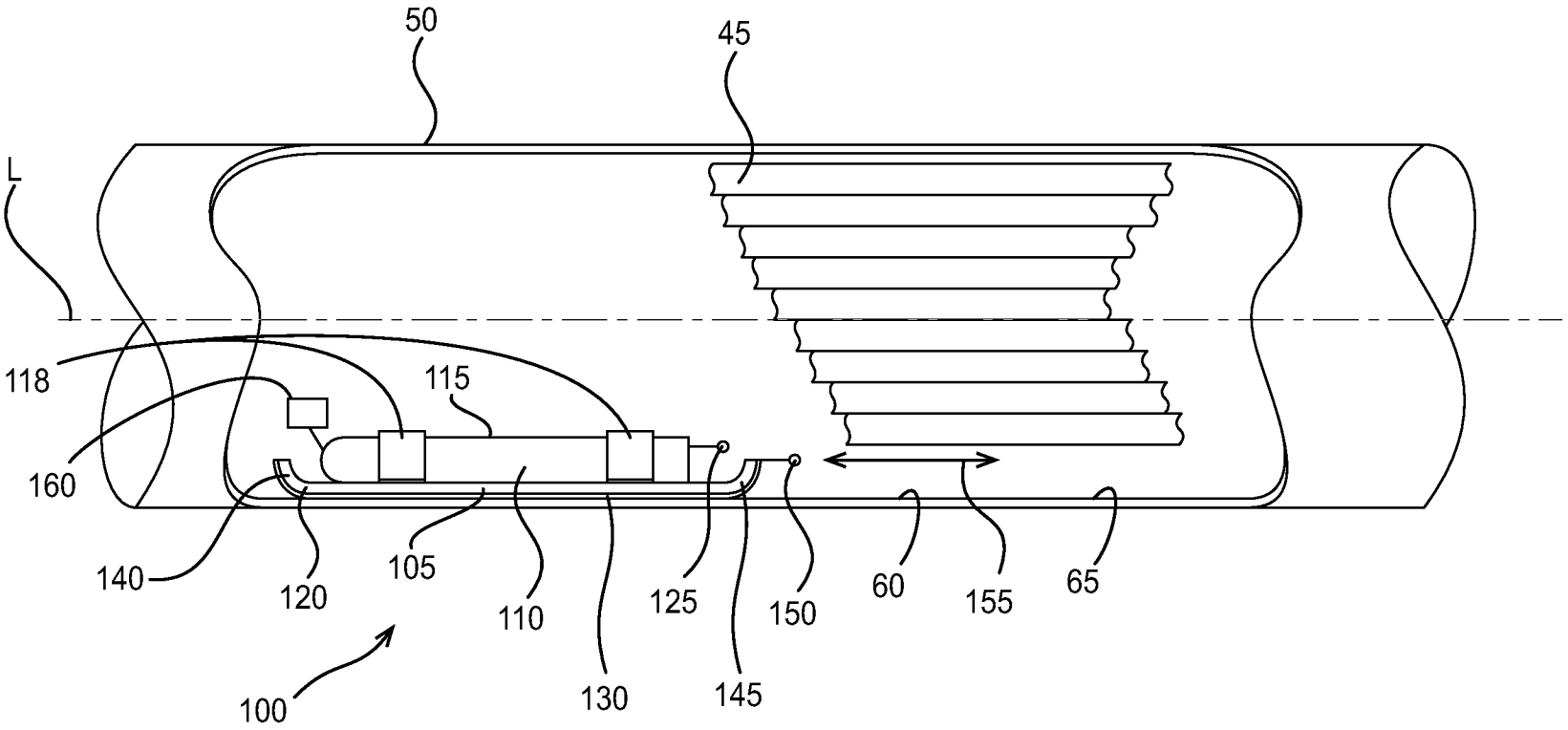
FIG. 5 is a cross-section along arrows "5-5" in FIG. 4.

Directing attention to FIG. 4 and FIG. 5, a vibrating system for removing snow and/or ice from the exterior surface 70 of a sheath 50 may be used. The sheath 50, which may typically be round, surrounds a plurality of strands 45 and has a longitudinal axis L. As illustrated in FIGS. 4 and 5, the module 100 may be inserted within the interstitial space 55 between the strands 45 and the bottom 65 of the sheath 50. The module 100 has a body 105 with a mass 110, a vibrator 115, and a base 120. The vibrator 115 imparts a vibration, which may be a high or low frequency, to the mass 110 which in turn imparts focused energy into the sheath 50 to remove by vibration accumulated snow and/or ice from the exterior surface 70 of the sheath 50. However, it should be appreciated that the module 100 may be positioned against the inner wall 60 of the sheath 50 at a location other than the bottom 65 of the sheath 50.

The module 100 fits within the interstitial space 55. The base 120 of the module 100 contacts and conforms to the shape of the inner wall 60 of the sheath 50. If a layer 130 of low friction material is applied to the base, then the layer 130 contacts and conforms to the shape of the inner wall 60 of the sheath 50.

In FIG. 4 and FIG. 5, the mass 110 and the vibrator 115 are illustrated as a single vibrator/mass unit 117. Such a unit 117 is available as a vibrator head from Northrock Industries, Inc. or as an electric high frequency internal vibrator from Wacker Neuson.

The term "attached" used herein to describe the relationship of the vibrator and the mass means that the vibrator is within the mass, the mass is within the vibrator, or that the vibrator is separate from but externally mounted to the mass. The vibrator 115 may be activated through an energy connector 125 which may provide a source of electrical, hydraulic, or pneumatic power to drive the vibrator 115.

Figure 6:
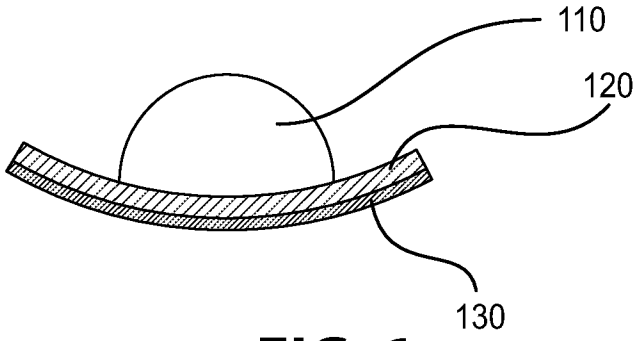
FIG. 6 is a sketch of the module with the mass and the base as one part.

As illustrated in FIG. 4, the base 120 is attached to the vibrator/mass unit 117 and the base 120 has a curved shape which conforms to a portion of the inner wall 60 of the sheath 50. The vibrator/mass unit 117 may be secured to the base 120 using one or more clamps 118. In another embodiment, the base 120 is integral with the bottom of the vibrator/mass unit 117 and has a curved shape to conform to the curvature of the inner wall 60 of the sheath 50 as illustrated in FIG. 6.

In one embodiment, the base 120 slides by low friction over the inner wall 60 of the sheath 50 and, to promote such sliding and to protect the inner wall 60 of the sheath 50, the outer surface of the base may have a layer 130 of low friction material (FIG. 4) such as Polytetrafluoroethylene (PTFE).

Figure 7:
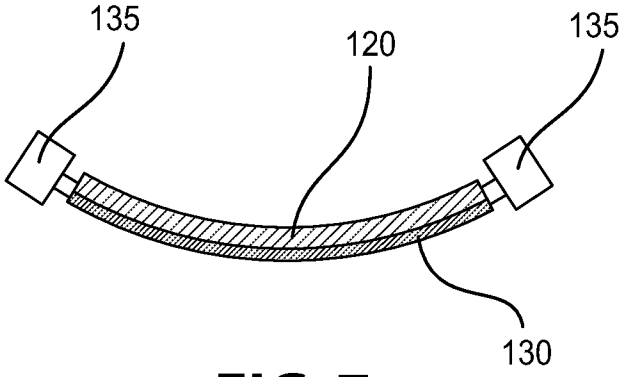
FIG. 7 is a sketch of the base supported by optional rollers.

In the alternative, the base 120 may have rollers 135 (FIG. 7) attached thereto and the rollers 135 contact the inner wall 60 of the sheath 50 to impart vibration to the sheath 50. It is also possible to provide a drive mechanism for the rollers 135 such that they are powered to propel the module 110 within the sheath 50.

Overall, the collective height of the vibrator/mass unit 117 and the base 120, including a clamp 118 if utilized, the low friction material 130 if utilized, and the rollers 135 if utilized, should be less than the height of the interstitial space 55.

As illustrated in FIG. 5, the base 120 of the module 100 has ends 140, 145 that may be sloped upwardly to accommodate irregular surfaces which may be present on the inner wall 60 of the sheath 50. As illustrated in FIG. 5, one or both of these ends 140, 145 may be curved upwardly.

As illustrated in FIG. 2, a typical cable 20 is sufficiently vertically oriented such that a module 100 placed within the interstitial space 55 at a higher elevation will travel within the sheath 50 by gravity and by the vibratory action of the module 100. To retrieve the module 100, to reset the module 100 at a high elevation to travel again through the sheath 50, or to assist movement of the module 100, a tether 150 (FIG. 5) attached to the body 105 may be used to pull the module 100. There may be a tether on each side of the module 100 to provide the capability of pulling the module 100 in either direction.

As illustrated by arrows 155 in FIG. 5, the module 100 may travel back and forth within the sheath 50 along the bottom 65 of the inner wall 60. Travel through the sheath 50 may also be enhanced through rollers 135 that, as mentioned, may be powered.

The sheath 50 is, as illustrated, circular. However, the sheath may also be round to include, but not limited to, elliptical and other round shapes. The sheath may also be other shapes, such as rectangular, depending upon design constraints.

Figure 8:
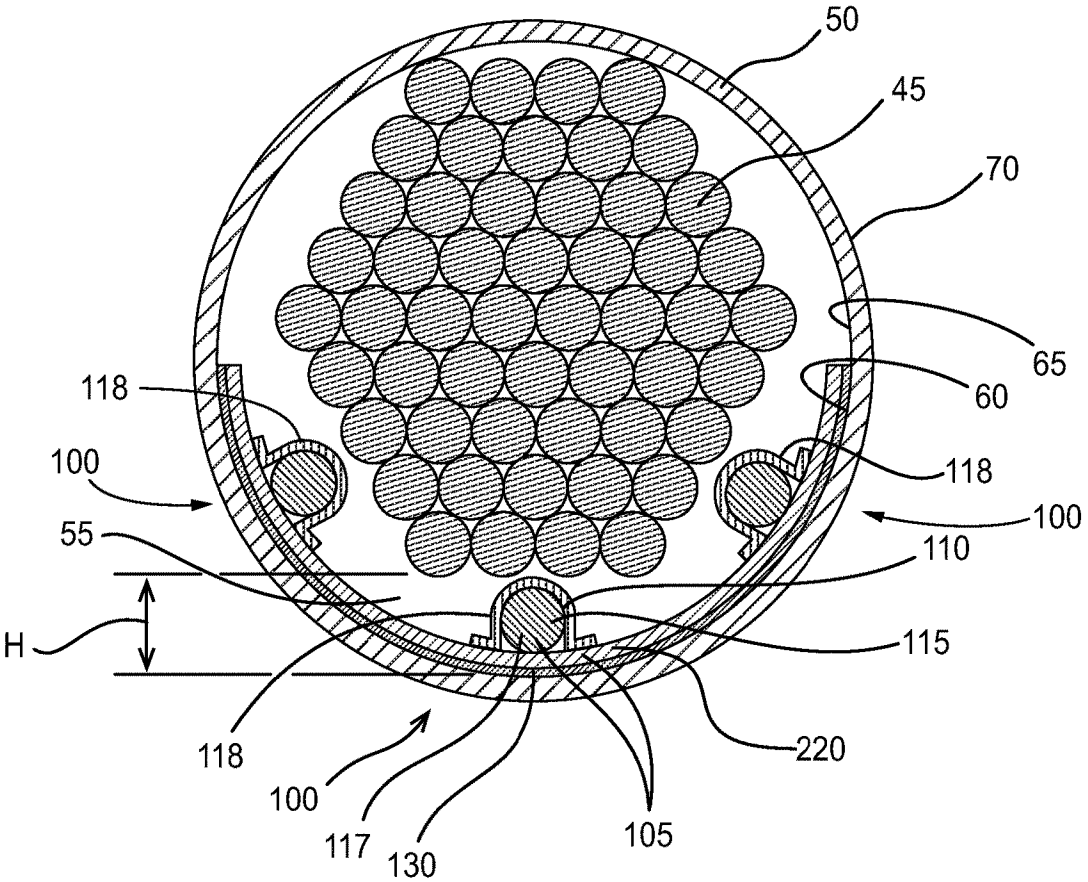
FIG. 8 is a cross-section along arrows "3-3" in FIG. 2, but include multiple deicing modules.

While so far discussed is a single vibrator/mass unit 117 in the module 100 within the sheath 50, directing attention to FIG. 8, it is possible to utilize multiple vibrator/mass units 117 on one or more modules within the interstitial space 55. The vibrator/mass units 117 may be attached to a single base 220, or as illustrated in FIG. 4, a single vibrator/mass unit 117 may have a dedicated base 120 such that each vibrator/mass unit 117 in FIG. 8 would have a separate base. Just as before, the vibrator/mass unit 117 may be separate from but attached to, or integral, with the base 120, 220.

When multiple vibrator/mass units 117 are utilized, then the collective height of each of the vibrator/mass units 117, the base 220, the clamp 118 if utilized, the low friction material 130 if utilized, and the rollers 135 if utilized, should be less than the height between the inner wall 60 and the cable strands 45 in the region of the particular vibrator/mass unit 117 indicated, for example, by the interstitial space 55. While the modules 100 in FIG. 8 extend along an arc about ½ of the circumference of the inner wall 60, the only limitation for location of the modules is the availability of sufficient height between the strands and the inner wall of the sheath at a particular location along the inner wall. Under certain circumstances, it may be possible for one or more modules 100 to span the circumference of the inner wall 60 along an arc up to 350 degrees. Furthermore, the base 120 of a single module may span the circumference of the inner wall 60 along an arc up to 350 degrees.

The subject invention is also directed to a method for vibrating a sheath 50 containing a plurality of strands 45 and having an interstitial space 55 between the strands 45 and the interior wall of the sheath 65. The method involves using the module 100, described herein, and may be comprised of the steps of 1) positioning the module 100 within the interstitial space 55 of the sheath 50 and 2) activating the vibrator 115 to impart vibration to the sheath 50.

The module 100 may be moved along the sheath 50 to impart vibration along a length of the sheath 50. The module 100 may travel within the sheath 50 by gravity. Using a tether 150 attached to the module 100, the module 100 may be urged in one direction or another. The module 100 may also have rollers 135 and the rollers 135 may be powered to move the module 100 through the sheath 50. It is also possible to perform this method using more than one vibrator/mass unit 117 within the sheath 50.

Utilizing such a module 100 within the interior of the sheath 50, a system can be deployed and operated separate from the harsh elements that often cause high maintenance costs associated with other proposed systems and, in particular, such a system would mitigate any damage to the exterior of the sheath 70 experienced by the current industry standard external scraping system.

Using the tether 150, the module 100 can be retrieved up to its deployment position using, for example, a winch. The vibrating mass 110 may be powered by a fixed line to an external electrical, hydraulic, or pneumatic power source or to an accompanying power source mounted on a separate module located within the interstitial space proximate to the module 100.

It is entirely possible to include a separate module to assist in longitudinal translation of the module 100 within the sheath 50. Such a module could have driven wheels that provide an additional force to push or pull the module 100 along the sheath 50. Finally, a lighted camera 160 could be added to the module 100 or to a separate module to obtain a visual record of the internal space in which the system operates.

While the discussion herein has been directed to cable stayed bridges, the subject invention may be used in a number of other applications including, but not limited to, suspension bridge main cables and suspension bridge suspender cables. The subject invention may also be used for building applications such as gutters, roof edges, and roof soffits, and with these and other appendages on skyscrapers and other buildings.

While certain embodiments of the invention are shown in the accompanying figures and described herein above in detail, other embodiments will be apparent to and readily made by those skilled in the art without departing from the scope and spirit of the invention. For example, it is to be understood that this disclosure contemplates that to the extent possible, one or more features of any embodiment can be combined with one or more features of the other embodiment. Accordingly, the foregoing description is intended to be illustrative rather than restrictive.

The invention claimed is:

1. A module for placement inside a sheath having a longitudinal axis and for vibrating the sheath comprising a body having:

a) a mass;

b) a vibrator attached to the mass;

c) a base supporting the mass and vibrator and adapted to contact an inner wall of the sheath; and d) wherein the body has a tether attached thereto adapted for towing the body along the longitudinal axis of the sheath.

2. The module according to claim 1, wherein the vibrator is activated by one of electrical, hydraulic, or pneumatic power.

3. The module according to claim 1, wherein the base has a curved shape to conform to a curved inner wall of the sheath.

4. The module according to claim 3, wherein the base is the bottom of the mass and has a curved shape adapted to conform to a portion of the inner wall of the sheath.

5. The module according to claim 3, wherein the base is attached to the mass and the base has a curved shape adapted to conform to a portion of the inner wall of the sheath.

6. The module according to claim 3, wherein the outer surface of the base has a layer of low friction material.

7. The module according to claim 1, wherein the base has rollers adapted to contact the inner wall of the sheath.

8. The module according to claim 7, wherein the rollers are powered to propel the module.

9. The module according to claim 7, wherein the base has ends and the ends are sloped upwardly.

10. A vibrating system comprising:

a) a sheath, wherein the sheath surrounds a plurality of strands and there is an interstitial space between the strands and the inner wall of the sheath; and b) a module having a body with:

i) a mass;

ii) a vibrator attached to the mass; and iii) a base supporting the mass and vibrator;

wherein the module fits within the interstitial space and contacts the inner wall of the sheath.

11. The vibrating system according to claim 10, wherein the base conforms to the inner wall of the sheath.

12. The vibrating system according to claim 11, wherein the base has a layer of low friction material.

13. The vibrating system according to claim 10, wherein a tether is attached to the module for moving the module within the sheath.

14. The vibrating system according to claim 10, further including at least one additional module with a mass attached wherein at least one additional module fits within the interstitial space for vibrating the inner wall of the sheath.

15. A method for vibrating a sheath surrounding a plurality of strands and having an interstitial space beneath the strands and the inner wall of the sheath, wherein the method uses a module with a vibrating mass and comprises the steps of:

a) positioning the module within the interstitial space of the sheath and against the inner wall of the sheath;

b) vibrating the mass to impart vibration to the sheath; and c) moving the module along the sheath to impart vibration along the sheath.

16. The method according to claim 15, wherein the module travels within the sheath by gravity.

17. The method of claim 15, wherein the module is tethered and moved within the sheath using the tether.

18. The method according to claim 15, wherein the module has rollers and the rollers are powered to move the module through the sheath.

* * * * *